US005677023A

United States Patent [19]

Brown

[11] Patent Number: 5,677,023

[45] Date of Patent: Oct. 14, 1997

[54] REINFORCED FABRIC INFLATABLE TUBE

[76] Inventor: Glen J. Brown, 458 Thayer Rd., Santa Cruz, Calif. 95060

[21] Appl. No.: 728,218

[22] Filed: Oct. 10, 1996

[51] Int. Cl.[6] ..... B29D 22/00

[52] U.S. Cl. ..... 428/36.6; 428/36.8

[58] Field of Search ..... 428/36.1, 36.6, 428/36.8

[56] References Cited

U.S. PATENT DOCUMENTS 3,705,429 12/1972 Nail ..... 5/349

3,899,797 8/1975 Gunst ..... 5/350

*Primary Examiner*—Christopher Raimund

*Attorney, Agent, or Firm*—Frank C. Price

[57] ABSTRACT

An inflated tube for use as a structual element has the distinction of using spiralling, high strength ribbons mounted on a fabric skin containing a bladder. Ribbons are also mounted on the outside of the skin parallel to the axis of the tube to reinforce the tube against bending forces. The use of ribbons provides a less expensive structural element than that made of woven fibers. The application is for only moderate loads and moderate spans compared to the those made of woven fibers.

6 Claims, 1 Drawing Sheet

REINFORCED FABRIC INFLATABLE TUBE

BRIEF SUMMARY OF THE INVENTION

This invention provides a material of various designs which is used as the pressure-restraining cover for an inflatable tube. The cover allows high pressures for high structural stiffness and strength and additionally provides curvature for the end product to meet design requirements where curvature is an asset. Airbeams constructed with this reinforcement are superior in their cost effectiveness.

Fabric reinforced and braid reinforced airbeams are known. Fabric airbeams are constructed of fabric tubes, either made on a circular loom or with seams, with the faric warp and fill yarns oriented at zero and ninety degrees respectively to the tube axis. Airbeams are also in use that use braided fibers at equal and opposite bias angles relative to the tube axis. These include fiber structures parallel to the tube axis in such locations around the tube's circumference that the tube is strengthened and stiffened according to a particular structural requirement.

This invention describes a fabric reinforcing which involves high tensile strength ribbons sewn on a foundation fabric tube in a double spiral pattern. Additionally, reinforcing ribbon is attached along a length of the foundation fabric parallel to the axis of the tube. It is the use of such high strength ribbons, the strength and stiffness they add, and the ease with which they can be applied that makes this invention unique. Inside the fabric tube there is an elastomeric tube to hold the pressurizing gas which provides tension to the fabric and reinforcing ribbons.

The principle of operation is that the spiral ribbons provide shear resistance to the beam while the lengthwise (axial) ribbons provide bending strength and stiffness. These are significant improvements over a simple fabric tube because, with its fabric with 0–90 degree yarn orientation, no shear resistance is provided and because these new axial ribbons attached to the tube on opposite sides increase the moment of inertia for bending in that plane. These properties are further enhanced by using ribbon with high strength and stiffness.

DETAILED DESCRIPTION

The tube of this invention has at least the following elements:

an inner bladder of gas-impermeable elastomeric material fabricated to conform to the interior of the outer elements of the construction;

a gas inlet port for inflation;

a fabric skin in tube shape covering the bladder;

reinforcing ribbon attached to the skin in at least two places, running parallel to the axis of the tube for its full length;

spirals of reinforcing ribbon, two each, spiralling in opposite directions and attached to the skin.

The tube may optionally include the following elements:

a zipper or other fastening means running the length of the skin to allow access to the interior of the fabric portion and to insert or service the liner;

an elastomeric, abrasion resistant coating on the fabric skin;

load attachment elements stitched or bonded to the fabric skin;

the skin with bias oriented fibers.

Figure 2:
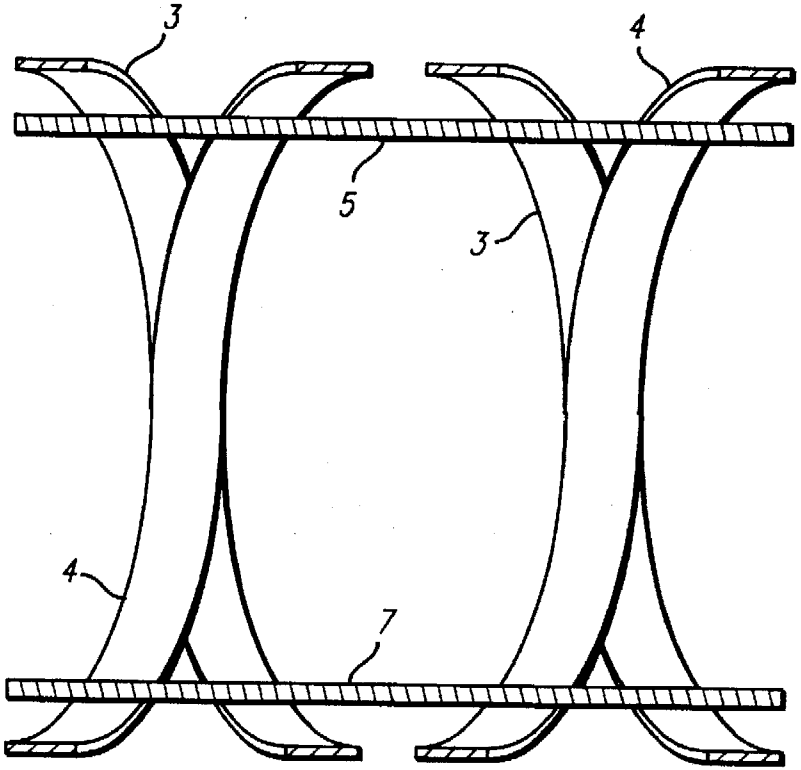
FIG. 2 shows a cross section looking down the axis of the tube.
Figure 1:
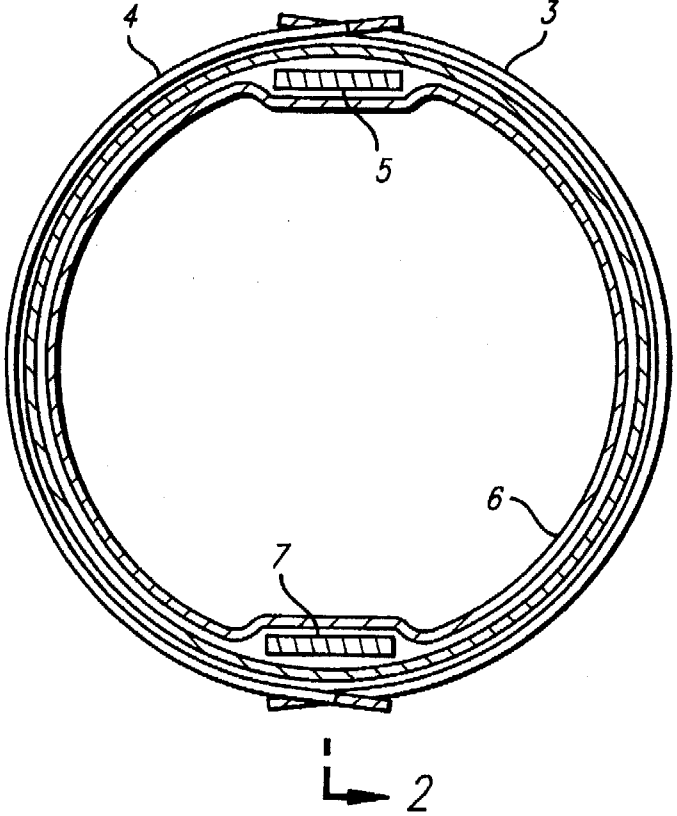
FIG. 1 shows a side view of a tube.

FIG. 1 shows the outer skin 1 which can be made from low modulus yarn such as Nylon or polyester. The reinforcing ribbons 2 and 3, made of high modulus yarn such as Kevlar or Spectra, spiral in opposite directions oriented at a high bias angle, typically 75 degrees. The axial reinforcing ribbons 4 and 5 are located radially opposite or substantially opposite one another in the plane of the expected applied bending load. There will usually be a fill/dump valve fitting mounted through and on the wall, not shown. The fabric of the skin 6 can be seen in a cutaway of the bladder. The bladder is 7.

The construction of the air beam is conveniently and economically achieved by a combination of stitching, bonding and welding of the various elements. Straight beams are made by using axial ribbons of equal length. Beams that become curved upon inflation to form arches are useful for shelters. Curved beams can be made by providing the axial ribbons with slightly different lengths, the differential length controlling the curvature.

The intention of this invention is to provide an economical alternative to braided airbeams for applications having moderate spans and moderate loads such that the required working pressure is 30 psi or less.

I claim:

1. A reinforced, inflatable tube comprising:

a fabric skin, two spirals of reinforcing ribbon, two or more reinforcing ribbons oriented parallel to the axis of said tube; said spirals spiralling in opposite directions, said spirals attached to said skin; said axially parallel ribbons attached to said skin, said parallel ribbons spaced apart around the circumference of said skin, said skin and said ribbons forming the outer elements of construction of said tube; an inner bladder of gas-impermeable elastomeric material fabricated to conform to the interior of said outer elements; a gas inlet port for inflation.

2. The tube of claim one with the weave of the skin in a bias orientation.

3. The tube of claim 1 with an abrasion resistant coating applied to the exterior of the tube.

4. The tube of claim 1 with low modulus fabric and high modulus ribbon.

5. The tube of claim 1 in which there is a zipper along the length of the tube.

6. The tube of claim 1 in which said tube is curved and in which said axially parallel ribbons have differing lengths to affect such curvature.

* * * * *